US005573485A

United States Patent [19]

Geschwender

[11] Patent Number: 5,573,485

[45] Date of Patent: Nov. 12, 1996

[54] EXERCISING AND STRETCHING APPARATUS

[76] Inventor: Robert C. Geschwender, 3855 Orchard St., Lincoln, Nebr. 68503

[21] Appl. No.: 457,270

[22] Filed: May 31, 1995

[51] Int. Cl.[6] ..... A63B 21/008

[52] U.S. Cl. ..... 482/112; 482/132; 482/142; 482/130; 482/907

[58] Field of Search ..... 482/132, 142, 482/130, 111, 112, 10, 907; 601/122, 128, 123, 124, 125, 126, 127, 97, 98, 99

[56] References Cited

U.S. PATENT DOCUMENTS

| | | | |
|---|---|---|---|
| 2,123,765 | 7/1938 | Brobery | 601/122 |
| 3,835,844 | 9/1974 | Lang | 601/128 |
| 4,066,259 | 1/1978 | Brentham | 482/10 |
| 4,302,005 | 11/1981 | Silberman | 482/10 |
| 4,768,779 | 9/1988 | Oehman, Jr. et al. | 482/112 |
| 5,147,259 | 9/1992 | Hutchins | 482/145 |
| 5,324,247 | 6/1994 | Lepley | 482/112 |
| 5,393,286 | 2/1995 | Cheng | 482/130 |

FOREIGN PATENT DOCUMENTS

| | | | |
|---|---|---|---|
| 0149824 | 2/1951 | Australia | 601/122 |

*Primary Examiner*—Lynne A. Reichard

*Attorney, Agent, or Firm*—Merchant, Gould, Smith, Edell, Welter & Schmidt, P.A.

[57] ABSTRACT

The disclosed exercise apparatus manipulates the back in a manner intended to strengthen back muscles and maintain spine flexibility. Adjacent arrays of rollers are mounted on a frame in a manner that allows the arrays of rollers to be secured in a first position relative to one another, wherein adjacent pairs of rollers are coaxially aligned, and in a second position relative to one another, wherein adjacent pairs of rollers are out of alignment.

38 Claims, 5 Drawing Sheets

FIG.2a
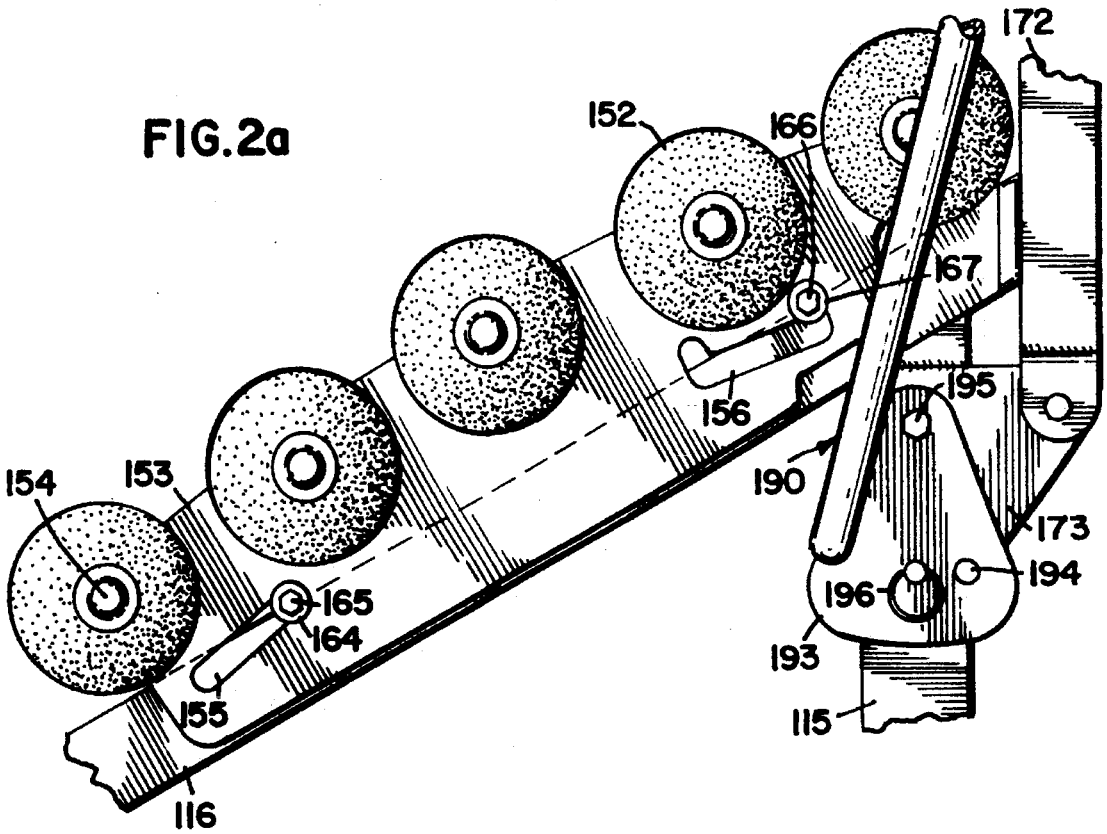
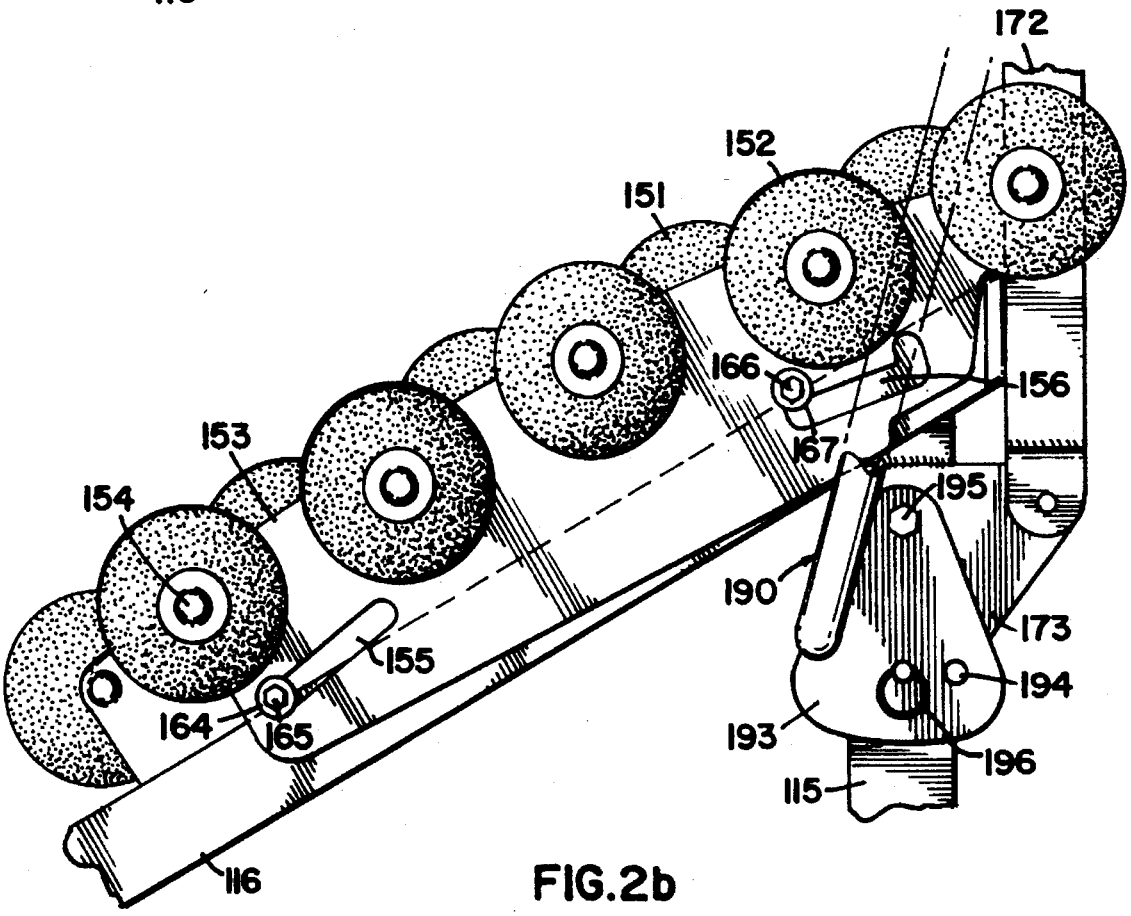
FIG.2b

EXERCISING AND STRETCHING APPARATUS

FIELD OF THE INVENTION

The present invention relates to exercise equipment and more particularly, to a device on which a user lies supine and exercises and stretches his or her back.

BACKGROUND OF THE INVENTION

Those skilled in the art recognize that an average person can improve his or her level of physical fitness by strengthening the back muscles and maintaining flexibility of the spine, and further, that a variety of devices have been developed for such purposes. One such device is designated as 900 and identified as "Prior Art" in FIG. 4. The Prior Art device 900 is a product of Back Technologies, Inc. of Everett, Wash., and is sold under the trademark THE BACK MACHINE.

The Prior Art device 900 includes a generally L-shaped frame 910 extending from a front end 911 to a rear end 912. A relatively longer segment 913 extends upward and rearward from the front end 911 and joins a relatively shorter segment 914, which extends from the common juncture downward and rearward to the rear end 912. A first transverse support 915 is secured to the front end 911, and a second transverse support 916 is secured to the rear end 912. The transverse supports 915 and 916 extend perpendicular to a plane defined by the substantially L-shaped frame 910 and cooperate to support the device 900 relative to a floor surface.

A padded platform 920 is mounted on the relatively longer segment 913 between the front end 911 and the juncture with the relatively shorter segment 914. The padded platform 920 functions as a seat for a user of the device 900. The platform 920 is not adjustable along the length of the frame 910 to accommodate users of different sizes and/or having different needs. Also, no structure other than the first transverse support 915 and/or the floor surface itself is available to support a user's feet.

A spine 930 is mounted on the relatively longer segment 913 between the platform 920 and the juncture with the relatively shorter segment 914. Pairs of rollers 931 and 932 extend from opposite sides of the spine 930, and each of the pairs shares a common axis of rotation. Every other pair of rollers 932 is relatively shorter in length. Adjacent pairs 931 and 932 are arranged relative to one another to define a slight curve that defines a mean angle of approximately 15 degrees relative to the floor surface, and that may be described as upwardly convex relative thereto. The rollers 931 and 932 cooperate to support the back of a user lying backward from a seated position on the platform 920.

A head support 940 is pivotally mounted to the frame 900 proximate the juncture between the relatively longer segment 913 and the relatively shorter segment 914. The head support 940 includes a pair of flanges 941 having three relatively smaller rollers 942 disposed therebetween, and three pairs of relatively larger rollers 943 extending from opposite sides thereof. The rollers 942 and 943 cooperate to support the head of a user lying supine on the rollers 931 and 932.

A linkage 950 extends from the frame 910 to the head support 940 at a distance from their common pivot point. The linkage 950 includes a spring mechanism that resists pivoting of the head support 940 away from the frame 910.

The greater the degree of pivoting, the greater the potential energy stored in the spring mechanism 951 which could potential cause injury upon abrupt release thereof.

A U-shaped member 960 is mounted on the relatively shorter segment 914 proximate the rear end 912. The U-shaped member 960 extends upward and slightly rearward from the relatively shorter segment 914. Handles 961 extend from opposite ends of the U-shaped member 960, toward one another and parallel to the second transverse support 916. A user lying supine on the rollers 931 and 932 reaches rearward beyond his or her head and grasps the handles 961 to pull himself or herself rearward over the rollers 931 and 932, typically while also pushing against the floor with his or her feet. The handles 961 also provide a base against which force may be exerted and transmitted through the user's neck to pivot the head support 940 downward and rearward.

Another U-shaped member 970 is mounted on the relatively longer segment 913 beneath the rollers 931 and 932 and proximate the juncture with the shorter segment 914. This U-shaped member 970 extends upward and forward at an angle approximately perpendicular to a plane defined by the other U-shaped member 960. The ends of this U-shaped member 970 terminate in handles 971 that may facilitate mounting and dismounting of the device 900 or perhaps provide a second base against which a user would push rather than pull in order to traverse the rollers 931 and 932 and move the head support 940.

Although suitable in some respects, the Prior Art device 900 nonetheless suffers from certain shortcomings. For example, the device 900 lacks versatility, not only in terms of accommodating users of different sizes and/or having different needs, but also in terms of facilitating more than one specific exercise.

The relatively slight slope of the roller assemblies 931 and 932 relative to the floor surface may prove insufficient for purposes of manipulating and exercising the lower back of some individuals. Furthermore, the spring mechanism 951 requires significant force to be exerted through a person's neck in order to pivot the head support 940 downward, and a sudden release of the accumulated potential energy could result in injury. Moreover, the combination of the spring mechanism 951 and the relatively slight slope of the roller assemblies 931 and 932 results in progressive loading of a person's spine from the head down, which is not only unnatural, but also may place undue strain on a person's neck.

The rollers 942 and 943 on the head support 940 are undesirable because they can tangle and/or pull a person's hair. Also, the head support 940 is not wide enough to support any portion of a person's shoulders. Accordingly, a need remains for an apparatus that satisfactorily exercises and stretches a person's back.

SUMMARY OF THE INVENTION

A preferred embodiment of the present invention provides an apparatus that facilitates manipulation of a person's back in a manner that strengthens back muscles and maintains spine flexibility. Generally speaking, the preferred embodiment includes a frame designed to rest upon a floor surface and a back support mounted on said frame.

The back support includes a first set of back supporting rollers rotatably mounted on a first bracket, and a second set of back supporting rollers rotatably mounted on a second bracket. Each roller in a set of rollers extends along a longitudinal axis perpendicularly away from a respective bracket. A line drawn perpendicular through or proximate each of the axes in either set of rollers forms an arc having a radius of approximately four feet. A line drawn perpendicular through the axes of the end rollers in either set forms an angle of approximately 30 degrees relative to the floor surface. A person arches back and forces himself or herself upward across the rollers to exercise and stretch his or her back. The 30 degree incline provides sufficient slope to focus a working load on the person's back and spine, to the relative exclusion of the neck, as the body moves over the rollers.

The brackets are movably mounted to opposite sides of the frame by means of pegs extending perpendicularly away from opposite sides of the frame, a generally linear slot formed in an end of each bracket, and a generally U-shaped slot formed in an opposite end of each bracket. A separate peg engages an end of a each linear slot, and a separate peg engages a corresponding end of each U-shaped slot, to maintain the respective bracket in a position of relative stability on the frame. When the pegs are engaging like ends of respective slots, rollers on the first bracket are coaxially aligned with rollers on the second bracket. In this aligned configuration, the rollers provide support for a person's back and minimize the load on the person's discs.

When the pegs are engaging opposite ends of respective slots, rollers on the first bracket are out of alignment with rollers on the second bracket. In this staggered configuration, the rollers provide support for a person's back and effect a torsional manipulation of the person's spine.

A seat is mounted on the frame proximate the lower end of the roller sets. The seat contributes to support a person before and after each back arching iteration. A foot support is mounted to the frame in front of the seat to provide a base against which a person may push to facilitate travel across the rollers. The foot support is adjustable relative to the seat and relative to the floor surface to accommodate users of different sizes and to facilitate a range of back exercises. The foot support is cylindrical in shape and has a sufficiently large diameter to provide an effective foot support regardless of the orientation of a person relative thereto. The relative height of the foot support above the floor surface encourages positioning of a person's feet well above the path traveled by the person's back over the rollers, and thereby contributes to a downwardly directed force on the person's back during upward travel over the rollers.

One end of a pivot arm is pivotally mounted to the rear of the frame, and a head support is mounted on an opposite end of the pivot arm, generally above the rearwardmost roller in each set of rollers. One end of a force resisting cylinder is rotatably mounted to an intermediate portion of the pivot arm, and an opposite end of the force resisting cylinder is rotatably mounted to the frame, generally beneath the one end of the pivot arm. The pivot arm and the cylinder are generally parallel when the head support is in a rest position and the cylinder is in a relatively extended state. The arrangement is such that initial resistance to pivoting of the head support is minimal, and resistance increases as a function of pivotal deflection. The increasing resistance is intended to provide steady, accommodating support for the weight of a user's head as the pivot arm moves away from a generally vertical position.

The head support includes a padded platform mounted on a flange that extends beyond opposite sides thereof. Corners of the flange are bent upwards to provide ears proximate a lower end of the padded platform. A relatively smaller roller is rotatably mounted to each of the ears to engage and minimize scuffing of a person's shoulders and minimize any load on the person's neck. The rollers, the foot support, the seat, and the head support cooperate to support the body of a person using the apparatus.

A generally U-shaped member is secured to a pair of brackets, each of which has three holes formed therein. Two of the three holes are disposed at a radial distance from the third hole. Two holes are formed into each side of the frame at the same radial distance apart from one another. The third hole in each bracket is aligned relative to a respective upper hole in the frame, and a bolt passes through the aligned holes to pivotally mount the brackets relative to the frame. Either of the remaining two holes on each bracket may be alternatively moved into alignment with a respective lower hole in the frame, and a pin selectively passed through the aligned holes, to secure the U-shaped member in either of two orientations relative to the frame. A handle extends from each of the distal ends of the U-shaped member and toward the opposite distal end to provide a support against which a person may push and/or pull to facilitate travel across the rollers.

Many of the advantages of the present invention will become apparent to those skilled in the art upon a more detailed description of the preferred embodiment.

BRIEF DESCRIPTION OF THE DRAWING

With reference to the Figures, wherein like numerals represent like parts and assemblies throughout the several views.

FIG. 2*a* is a side view of a portion of the exercise apparatus shown in FIG. 1, depicting the right and left roller assemblies in alignment with one another;

FIG. 2*b* is a side view of a portion of the exercise apparatus shown in FIG. 2*a*, depicting the right and left roller assemblies out of alignment with one another;

DETAILED DESCRIPTION OF A PREFERRED EMBODIMENT

Figure 1:
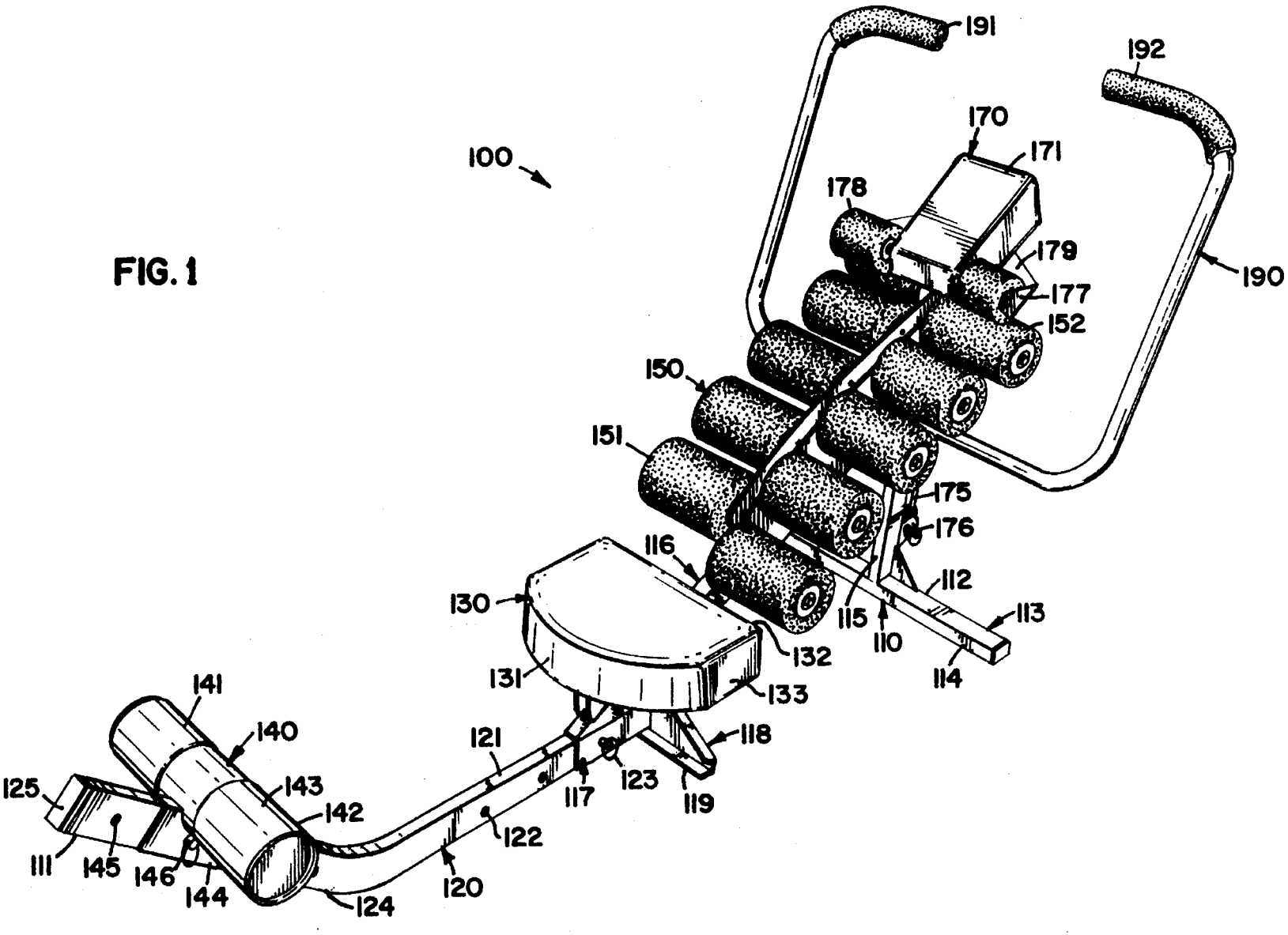
FIG. 1 is isometric view of a preferred embodiment exercise apparatus constructed according to the principles of the present invention.

A preferred embodiment exercise apparatus constructed according to the principles of the present invention is designated as 100 in FIGS. 1–3*b*. The apparatus 100 generally includes a frame 110, a seat 130, a foot support 140, a back support 150, a head support 170, and a handlebar 190.

The frame 110 is made of steel components and extends from a front end 111 to a rear end 112. The rear end 112 is defined by an inverted T-shaped member 113 having a transverse bar 114 that engages a floor surface 99 and an upright bar 115 that is connected to and extends upward from the transverse bar 114. An upper end of the upright bar 115 is connected to a beam or spine 116 that extends forward and downward from its juncture with the upright bar 115, thereby defining an angle A of approximately 30 degrees relative to the floor surface 99. An opposite, lower end of the spine 116 is connected to a U-shaped channel member 117 that opens toward the floor surface 99. A triangular brace 118 is connected to the channel member 117 and lies in a plane substantially parallel to a plane defined by the T-shaped member 113. The brace 118 includes a lowermost flange 119 that extends parallel to the transverse bar 114 and similarly engages the floor surface 99. The flange 119 and the transverse bar 114 cooperate to support the apparatus 100 relative to the floor surface 99.

The seat 130 is mounted to the spine 116, generally above the channel member 117 and the brace 118. A rearward edge of the seat 130 is straight and substantially parallel to the plane defined by the T-shaped member 113. A forward edge 131 of the seat 130 is generally arcuate and centered about a point behind a linear rearward edge 132 of the seat 130. The rearward edge 132 and the forward edge 131 are joined by a pair of opposite side edges 133 that extend substantially perpendicular to the rearward edge 132. The seat 130 is also padded for user comfort.

A forward member 120 includes a first rail 121 having a rectangular cross-section that corresponds to that of the channel member 117 and is slideably mounted relative thereto. A hole is formed transversely through the channel member 117, and a plurality of corresponding holes 122 are formed transversely through the first rail 121 to facilitate fastening of the first rail 121 in any of several positions relative to the channel member 117. In particular, the first rail 121 is moved through the channel member 117 until a desired hole 122 aligns with the hole in the channel member 117, at which point a clevis pin or detent pin 123 is inserted through the aligned holes. This adjustment feature provides a means for selectively configuring the apparatus 100 to accommodate persons of different heights.

The forward member 120 further includes a second rail 124 that is connected to and extends forward and upward from a forward end of the first rail 121, thereby defining an angle of approximately 45 degrees relative to the floor surface 99. The second rail 124 has a rectangular cross-section and a distal end that defines the front end 111 of the apparatus 100. A plug or cap 125 is mounted on the front end 111 to cover any rough edges and enhance the appearance of the apparatus 100.

The foot support 140 is mounted on a U-shaped channel member 144 having a cross-section that corresponds to that of the second rail 124. With the channel member 144 positioned so that the channel opens generally downward toward the floor surface 99, the channel member 144 is slideably mounted on the second rail 124. A hole is formed transversely through the channel member 144, and a plurality of corresponding holes 145 are formed transversely through the second rail 124 to facilitate fastening of the second rail 124 in any of several positions relative to the channel member 144. In particular, the channel member 144 is moved along the second rail 124 until the hole in the channel member 144 aligns with a desired hole 145 in the second rail 124, at which point a clevis pin or detent pin 146 is inserted through the aligned holes. This adjustment features provides a means for selectively configuring the apparatus 100 to vary the relative height of a user's feet and thereby vary the degree of force directed to the user's lower spine or lumbar area.

The foot support 140 is a cylindrical member having a diameter of approximately 3 inches. The foot support 140 is centered relative to the channel member 144 and mounted thereon so that equal portions 141 and 142 of the cylindrical member extend to each side of the channel member 144. The cylindrical portions 141 and 142 provide elevated supports or braces for a person's feet. A durable material 143 having a relatively high coefficient of friction is disposed about the circumference of the cylindrical portions 141 and 142 for maximum user comfort and safety.

Those skilled in the art will recognize that the first rail 121, channel member 117, and pin 123 cooperate to provide an effective means for adjusting the position of the foot support 140 relative to the seat 130 and rollers 151 and 152, and likewise, the second rail 124, the channel member 144 and the pin 146 provide an effective means for adjusting the position of the foot support 140 relative to the floor surface 99. However, those skilled in the art will also recognize that other means are available for adjustably mounting the foot support 140 relative to the frame 110, and that the present invention is not necessarily limited to the particular adjustment means shown and described herein.

The back support 150 includes two sets or pluralities of back supporting members 151 and 152. Each set of back supporting members 152 includes a flange 153 stamped from a sheet of metal. Five rods or shafts 154 extend from one side of each flange 153, relatively nearer an upper edge thereof. The shafts 154 extend perpendicularly away from a respective flange 153 and parallel to the floor surface 99. The centers of the shafts 154 are spaced an equal distance from one another and lie on or near a common arc having a radius of approximately four feet. Each of the back supporting members 152 may be described as a foam tube rotatably mounted on a respective shaft 154.

A generally linear slot 155 is formed in each flange 153 relatively nearer a forward end thereof. A peg 165 is connected to and extends substantially perpendicular away from each side of the spine 116 and through a respective slot 155. A head 164 on each peg 165 is larger than the width of the respective slot 155 and thereby maintains the respective flange 153 on the respective peg 165 and in close proximity to the spine 116. In this manner, each peg 165 and corresponding slot 155 cooperate to slideably mount a respective flange 153 relative to the spine 116.

A generally U-shaped slot 156 is formed in each flange 153 relatively nearer a rearward end thereof. The ends of each slot 156 may be said to extend generally upward, away from the floor surface 99. Another peg 166 is connected to and extends substantially perpendicular away from each side of the spine 116 and through a respective slot 156. A head 167 on each peg 166 is larger than the width of the respective slot 156 and thereby maintains the respective flange 153 on the respective peg 166 and in close proximity to the spine 116. In this manner, each peg 166 and corresponding slot 156 cooperate to slideably mount a respective flange 153 relative to the spine 116, and with the aid of gravity, the ends of each slot 165 allow a respective flange 153 to be locked in either of two positions relative to the spine 116. The slots 155 and 156 are configured and arranged in such a manner that each of the roller assemblies 151 and 152 define the same general arc in either of the two locked positions.

When the sets of back supporting members 151 and 152 occupy like positions relative to the spine 116, as shown in FIG. 2*a*, for example, corresponding rollers on each of the sets (or "roller pairs") are axially aligned relative to one another and thus, essentially function as a single continuous roller extending across a person's back but providing clearance for the person's spine. On the other hand, when either of the sets of back supporting members 151 and 152 is moved to a different position relative to the spine 116, as shown in FIG. 2*b*, for example, the roller pairs are moved out of alignment, and thus, do not function as a single continuous roller. This unaligned or staggered arrangement of the roller pairs effects a different, relatively torsional manipulation of a person's back. Those skilled in the art will recognize that the slots 155 and 156 and the pegs 165 and 166, respectively, cooperate to provide an effective means for relative adjustment of the roller assemblies 151 and 152, but also, that other means are available for adjustably mounting the roller assemblies 151 and 152 relative to the frame 110 and one another, and that the present invention is not necessarily limited to the particular means shown and described herein.

The head support 170 includes a padded member 171 secured to one end of a pivot arm 172. An opposite end of the pivot arm 172 is rotatably mounted to an upper trunnion 173 extending rearward from the upright frame member 115. A flange 174 extends rearward from an intermediate portion of the pivot arm 172, and the rod end of a force resisting cylinder 175 is rotatably mounted to the flange 174. The cylinder end of the force resisting cylinder 175 is rotatably mounted to a lower trunnion 176 extending rearward from the upright frame member 115. In the preferred embodiment, the force resisting cylinder is a 22.5 pound air strut or pneumatic cylinder capable of supporting 22.5 pounds when the head support 170 is rotated back 90 degrees. Those skilled in the art will recognize that other means are available for resisting pivoting of the head support 170, and that the present invention is not necessarily limited to the particular means shown and described herein.

Figure 3A:
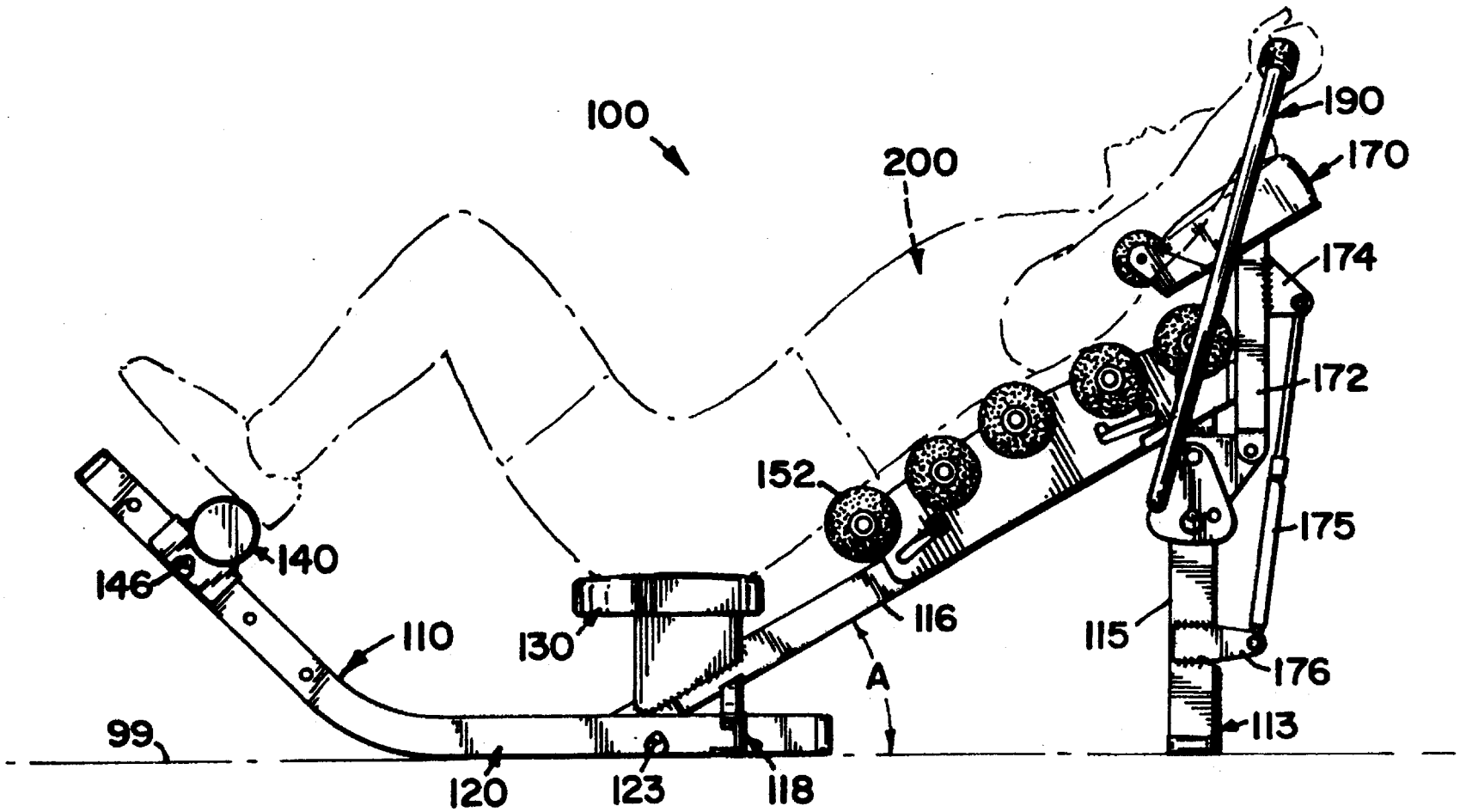
FIG. 3*a* is a side view of the exercise apparatus shown in FIG. 1, depicting a person in a rest position on the apparatus.

As shown in FIG. 3*a*, the pivot arm 172 and the pneumatic cylinder 175 extend substantially parallel to one another when the padded member 171 is in an upwardmost or rest position, generally above the rearwardmost roller in each of the sets of back supporting members 151 and 152. The arrangement of the pivot arm 172 and the pneumatic cylinder 175 is such that initial downward pivoting of the padded member 171 is met with minimal resistance from the pneumatic cylinder 175, since the direction of travel is generally transverse to the longitudinal axis of the cylinder 175. As downward pivoting proceeds, to a position shown in FIG. 3*b*, for example, the pivot arm 172 rotates to a greater degree than the pneumatic cylinder 175 and gradually encounters more and more resistance to pivoting as the angle between the pivot arm 172 and the pneumatic cylinder 175 increases, since the direction of travel gains a greater component in the direction of the longitudinal axis of the cylinder 175. In other words, the pneumatic cylinder 175 gradually supports more and more weight as needed due to rearward movement of the person over the rollers 151 and 152. As a person returns to a seated position, the pneumatic cylinder 175 exerts sufficient force to gradually and safely return the head support 170 to the upwardmost position.

A flange 179 extends beyond opposite sides of the padded member 171, and distal corners thereof are bent upward to provide ears 177 proximate a lower end of the padded member 171. Relatively small rollers 178 are rotatably mounted to the ears 177 to engage the shoulders of a user of the apparatus 100. These smaller rollers 178 allow force to be transmitted comfortably through a person's shoulders, rather than his or her neck, and rotate to avoid scuffing of the shoulders.

A generally U-shaped member or handlebar 190 is mounted on the upright member 115 proximate the upper trunnion 173. Two flanges or brackets 193 are secured to the handlebar 190 and extend parallel to one another. Three holes 194–196 are formed through each of the brackets 193. Two of the three holes (one of which is designated as 194 in FIGS. 2*a*–2*b*) are disposed at a radial distance from the third hole. Two other holes are formed into each side of the frame member 115 at the same radial distance apart from one another. The third hole in each bracket 193 is aligned relative to a respective upper hole in the frame member 115, and a bolt 195 passes through the aligned holes to pivotally mount the brackets 193 relative to the frame 110. Either of the remaining two holes in each bracket 193 may be alternatively moved into alignment with a respective lower hole in the frame member 115, and a detent pin 196 passed through the aligned holes, to selectively secure the U-shaped member 190 in either of two orientations relative to the frame 110. Those skilled in the art will recognize that other means are available for adjustably mounting the handlebar 190 to the frame 110, and that the present invention is not necessarily limited to the particular means shown and described herein.

In one orientation, shown in FIGS. 1–3*b*, the U-shaped member 190 extends upward and slightly rearward from the upright member 115. Handles 191 and 192 extend from opposite ends of the U-shaped member 190, toward one another and parallel to the floor surface 99. The handles 191 and 192 provide a support against which a person may push and/or pull to facilitate travel across the rollers. For example, a user lying supine on the rollers 151 and 152 may reach upward and rearward beyond his or her head and grasps the handles 191 and 192 to pull himself or herself rearward over the rollers 151 and 152, typically while also pushing against the foot support 140 with his or her feet.

In using the apparatus 100, a person 200 sits on the seat 130, lies backward against the rollers 151 and 152 and the head support 170, and places his or her feet against the foot supporting members 141 and 142. If the person 200 is not comfortable with the current configuration of the apparatus, he or she proceeds to (1) adjust the position of the rollers 151 and 152 relative to the seat 130; (2) adjust the position of the handles 191 and 192 relative to the frame 110; (3) adjust the position of the foot support 140 relative to the seat 130; and/or (4) adjust the position of the foot support 140 relative to the floor surface 99.

Figure 3B:
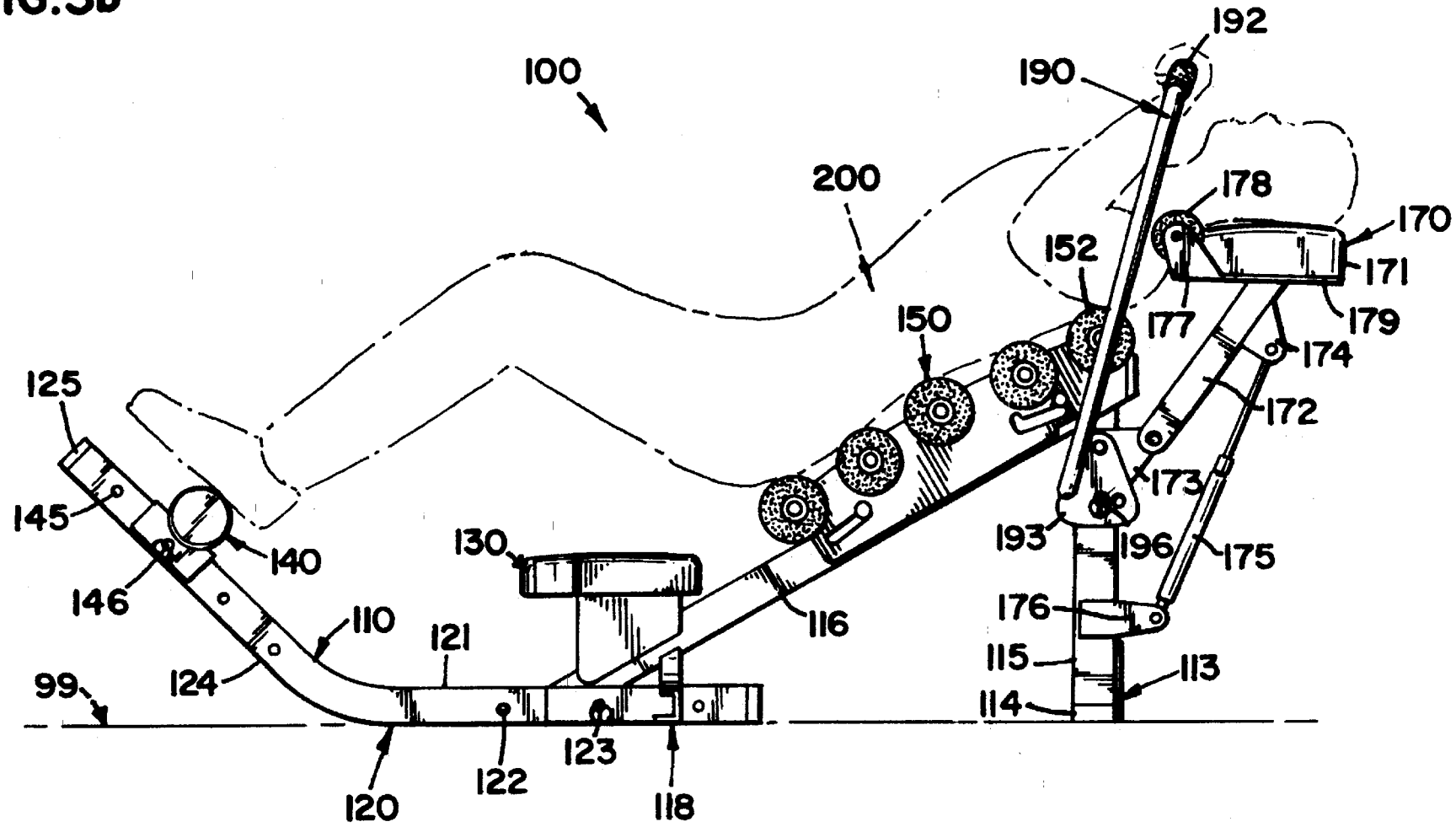
FIG. 3*b* is a side view of the exercise apparatus shown in FIG. 1, depicting a person in an upwardly displaced position on the apparatus.
Figure 4:
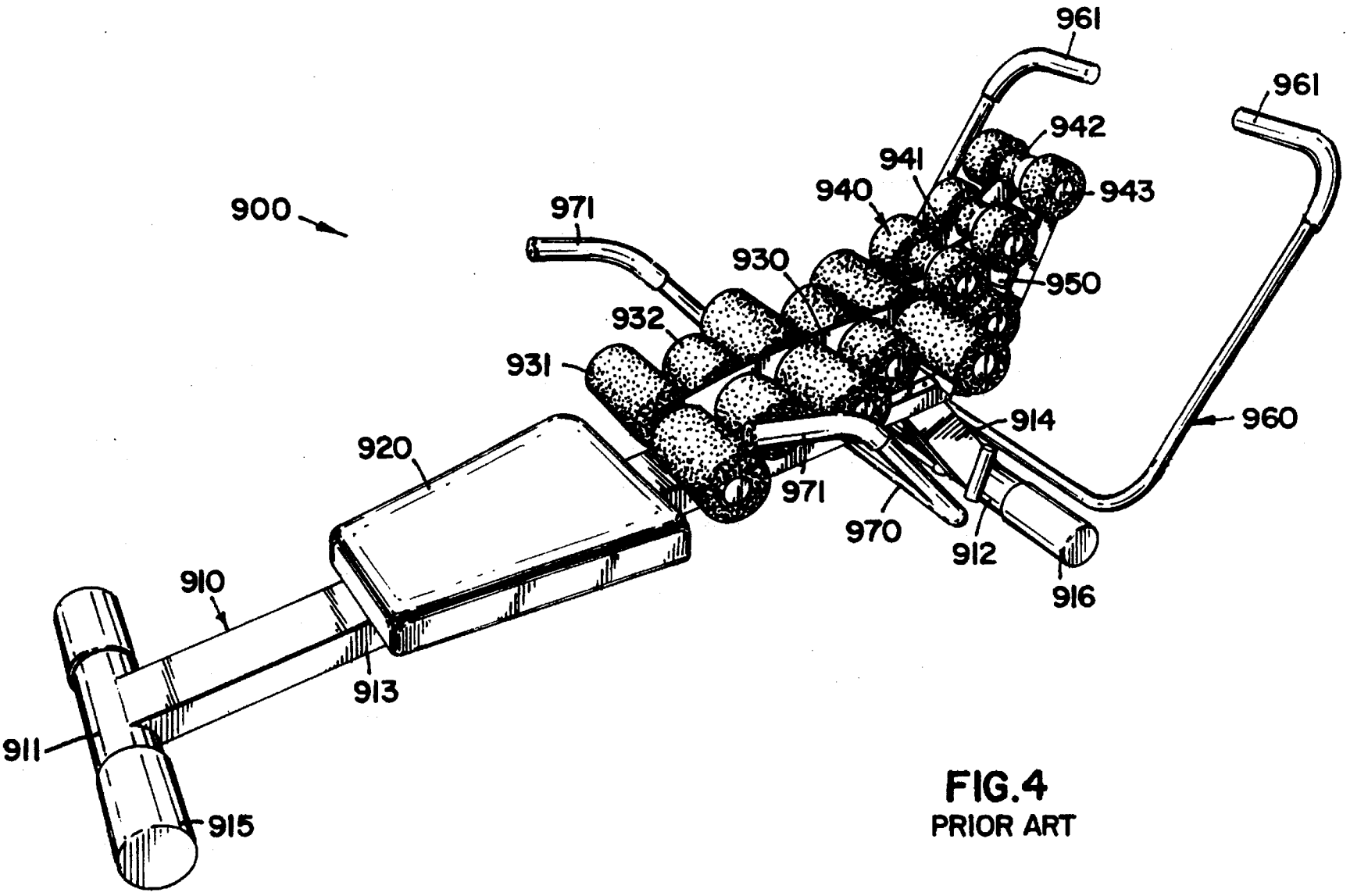
FIG. 4 PRIOR ART
FIG. 4 is a side view of a Prior Art exercise apparatus.

Once a comfortable configuration is obtained, the person 200 resumes his or her position on the apparatus 100 to begin exercising, as shown in FIG. 3*a*. The person 200 then has the option of (1) pushing with his her legs or (2) using both legs and arms to lift his or her weight off of the seat 130 and travel rearward to arrive in an arched posture on top of the roller arrays 151 and 152, as shown in FIG. 3*b*. During this motion, the weight of the person's head is carried by the head support 170, and the person's shoulders engage the smaller rollers 178 to ensure that excessive force is not placed on the person's neck. After a desired delay in the arched position, the person allows his or her weight to bring the body back across the roller arrays 151 and 152 and into a seated position. The person has the option of repeating this motion (1) with the same apparatus configuration; (2) with the roller arrays 151 and 152 adjusted to a different position relative to one another (to vary the way in which the back is manipulated); (3) with the foot support 140 at a different elevation above the floor surface 99 (to vary the magnitude of the load placed on the lumbar region of the back); and/or (4) with the handlebar 190 in a different orientation relative to the frame (to vary the magnitude and/or direction of the force being exerted through the person's arms).

The present invention has been described with reference to a preferred embodiment and a particular application. Those skilled in the art will recognize not only the many benefits of the present invention, but other ways of embodying and applying the present invention, as well. Accordingly, the scope of the present invention is to be limited only to the extent of the following claims:

I claim:

1. An exercise apparatus, comprising:

a frame designed to rest upon a floor surface;

a first plurality of back supporting members having respective longitudinal axes and mounted on said frame;

a second plurality of back supporting members having respective longitudinal axes and mounted on said frame proximate said first plurality of back supporting members, wherein said first and second pluralities of back supporting members cooperate to support a person's back; and an adjusting means, associated with said frame, for adjusting said first plurality of back supporting members relative to said second plurality of back supporting members between a first relative position, in which back supporting members in said first plurality are coaxially aligned relative to corresponding back supporting members in said second plurality, and a second relative position, in which said back supporting members in said first plurality are out of coaxial alignment with said corresponding back supporting members in said second plurality.

2. An exercise apparatus according to claim 1, wherein said back supporting members in said first plurality are cylindrical rollers that rotate relative to said frame, and said corresponding back supporting members in said second plurality are cylindrical rollers that rotate relative to said frame.

3. An exercise apparatus according to claim 2, wherein all of said rollers extend parallel to one another.

4. An exercise apparatus according to claim 1, further comprising a seat rigidly mounted on said frame nearer to the floor surface than said first and second pluralities of back supporting members, and a pair of handles rigidly mounted on said frame and disposed farther above the floor surface than said first and second pluralities of back supporting members.

5. An exercise apparatus according to claim 1, further comprising a seat mounted on said frame proximate a lowermost back supporting member in each of said first and second pluralities of back supporting members.

6. An exercise apparatus according to claim 5, further comprising a foot support mounted on said frame and disposed on a side of said seat opposite said back supporting members.

7. An exercise apparatus according to claim 6, further comprising another adjusting means, associated with said frame, for adjusting said foot support relative to said seat.

8. An exercise apparatus according to claim 7, wherein said another adjusting means includes a channel on said frame, a rail to which said foot support is secured, and a pin, and said rail telescopes within said channel, and both said rail and said channel have at least one hole formed transversely therethrough, and at least one of said rail and said channel has more than one hole formed transversely therethrough, and said pin inserts through aligned holes in said rail and said channel to releasably secure said foot support in one of a plurality of positions relative to said seat.

9. An exercise apparatus according to claim 8, wherein said rail extends substantially parallel to the floor surface from said opening to a juncture with a second rail, and said second rail extends upward from said juncture to said foot support and supports said foot support at a distance above the floor surface.

10. An exercise apparatus according to claim 1, wherein said adjusting means includes a bracket to which said first plurality of back supports is mounted, and a connecting means for connecting said bracket in at least two different positions relative to said frame.

11. An exercise apparatus according to claim 10, wherein said connecting means includes a peg that extends from said frame and releasably engages either end of a substantially U-shaped slot in said bracket, and a head on said peg that retains said bracket proximate said frame.

12. An exercise apparatus according to claim 11, wherein said connecting means further includes another peg that extends from said frame and releasably engages either end of a substantially linear slot in said bracket, and a head on said another peg that retains said bracket proximate said frame.

13. An exercise apparatus according to claim 12, wherein said U-shaped slot and said linear slot are configured and arranged in such a manner that in such a manner that all of said back supporting members remain generally in a common arc in both said first relative position and said second relative position.

14. An exercise apparatus according to claim 10, wherein said adjusting means further includes a second bracket to which said second plurality of back supporting members is mounted, and a second connecting means for connecting said second bracket in at least two different positions relative to said frame.

15. An exercise apparatus according to claim 14, wherein each of said connecting means includes a peg that extends from a respective side of said frame and releasably engages either end of a substantially U-shaped slot in a respective bracket, and a head on said peg that retains said respective bracket proximate said frame.

16. An exercise apparatus according to claim 1, further comprising a foot support mounted on said frame at a distance from said first and second pluralities of back supporting members, and another adjusting means, associated with said frame, for adjusting said foot support relative to the floor surface.

17. An exercise apparatus according to claim 16, wherein said another adjusting means includes a channel on said foot support, a rail to which said foot support is secured, and a pin, and said channel slides along said foot support, and both said channel and said rail have at least one hole formed transversely therethrough, and at least one of said channel and said rail has more than one hole formed transversely therethrough, and said pin inserts through aligned holes in said channel and said rail to releasably secure said foot support in one of a plurality of positions relative to the floor surface.

18. An exercise apparatus according to claim 1, further comprising a head support rotatably mounted to said frame proximate an uppermost back supporting member in each of said first and second pluralities of back supporting members.

19. An exercise apparatus according to claim 18, wherein said head support is mounted on a first end of a pivot arm, and a second, opposite end of said pivot arm is rotatably mounted to said frame, and a pneumatic cylinder extends between said pivot arm and said frame and provides resistance to rotation of said pivot arm relative to said frame.

20. An exercise apparatus according to claim 19, wherein said pneumatic cylinder is rotatably mounted to said frame generally beneath said second, opposite end of said pivot arm, and said pneumatic cylinder is rotatably mounted to said pivot arm between said first end and said second, opposite end, and said pneumatic cylinder and said pivot arm are substantially parallel when said pneumatic cylinder is relatively extended.

21. An exercise apparatus according to claim 1, further comprising a first handle mounted on said frame and disposed above an end of said first plurality of back supporting members, and a second handle mounted on said frame and disposed above an adjacent end of said second plurality of back supporting members, against which a person may exert a force to move the person's back relative to said back supporting members.

22. An exercise apparatus according to claim 1, wherein each back supporting member in said first plurality has a corresponding back supporting member in said second plurality, and all of said back supporting members are padded cylindrical rollers that extend substantially parallel to one another.

23. An exercise apparatus according to claim 1, wherein all of said back supporting members remain generally in a common arc in both said first relative position and said second relative position.

24. An exercise apparatus, comprising:

a frame designed to rest upon a floor surface;

pairs of cylindrical rollers rotatably mounted on said frame and designed to comfortably support at least a portion of a person's body, wherein each individual pair is arranged generally end to end, and adjacent pairs are arranged substantially parallel to one another, and said pairs are selectively positionable between a first configuration, wherein said pairs are coaxially aligned, and a second configuration, wherein said pairs are other than coaxially aligned.

25. An exercise apparatus according to claim 24, wherein in said first configuration, all said pairs are coaxially aligned, and in said second configuration, all said pairs are other than coaxially aligned.

26. An exercise apparatus according to claim 24, wherein one of each of said pairs of cylindrical rollers is supported on a bracket, and a generally U-shaped slot is formed in said bracket, and a peg extends from said frame and through said slot, and gravitational force acting on said bracket maintains either end of said slot in engagement with said peg.

27. An exercise apparatus according to claim 26, wherein a generally linear slot is formed in said bracket, and another peg extends from said frame and through said linear slot, and when said peg is at a first end of said U-shaped slot, said another peg is at a first end of said linear slot, and when said peg is at a second, opposite end of said U-shaped slot, said another peg is at a second, opposite end of said linear slot.

28. An exercise apparatus according to claim 24, wherein all of said rollers define a common arcuate surface in either of said first configuration and said second configuration.

29. An exercise apparatus, comprising:

a frame designed to rest upon a floor surface;

a back support mounted on said frame and designed to support a person's back in at least two different positions relative to the floor surface;

a pivot arm having a first end rotatably mounted to said frame and a second, opposite end;

a head support mounted to said second, opposite end and designed to support a person's head when the person's back is supported on said back support; and a force resisting cylinder having a rod end rotatably mounted to said head support between said first end and said second, opposite end, and having a cylinder end rotatably mounted to said frame beneath said first end, wherein said pivot arm and said force resisting cylinder are substantially parallel when said head support is in a rest position and said force resisting cylinder is in a relatively extended state, and pivoting of said pivot arm causes said force resisting cylinder to pivot to a lesser degree and thereby creates an angle between said pivot arm and said force resisting cylinder, and said angle increases as a function of said pivoting of said pivot arm, and resistance to .pivoting increases as a function of said angle;

a foot support mounted on said frame above the floor surface and designed to support a person's feet when the person's back is supported on said back support;

a first adjusting means, associated with said frame, for adjusting distance between said foot support and said back support; and a second adjusting means, associated with said frame, for adjusting distance between said foot support and the floor surface.

30. An exercise apparatus according to claim 29, wherein said back support includes a plurality of rollers rotatably mounted on said frame and extending substantially parallel to the floor surface and one another.

31. An exercise apparatus according to claim 29, wherein said first adjusting means includes a channel on said frame, a rail to which said foot support is secured, and a pin, and said rail telescopes within said channel, and both said rail and said channel have at least one hole formed transversely therethrough, and at least one of said rail and said channel has more than one hole formed transversely therethrough, and said pin inserts through aligned holes in said rail and said channel to releasably secure said foot support at one of a plurality of distances from said back support.

32. An exercise apparatus according to claim 29, wherein said second adjusting means includes a channel on said foot support, a rail to which said foot support is secured, and a pin, and said channel slides along said rail, and both said channel and said rail have at least one hole formed transversely therethrough, and at least one of said channel and said rail has more than one hole formed transversely therethrough, and said pin inserts through aligned holes in said channel and said rail to releasably secure said foot support at one of a plurality of distances from the floor surface.

33. An exercise apparatus according to claim 29, wherein said back support defines an angle of approximately thirty degrees relative to the floor surface.

34. An exercise apparatus, comprising a frame designed to rest upon a floor surface;

a back support mounted on said frame and designed to support a person's back in at least two different positions relative to the floor surface;

a pivot arm having a first end rotatably mounted to said frame and a second, opposite end;

a head support mounted to said second, opposite end and designed to support a person's head when the person's back is supported on said back support; and a force resisting cylinder having a rod end rotatably mounted to said head support between said first end and said second, opposite end, and having a cylinder end rotatably mounted to said frame beneath said first end, wherein said pivot arm and said force resisting cylinder are substantially parallel when said head support is in a rest position and said force resisting cylinder is in a relatively extended state, and pivoting of said pivot arm causes said force resisting cylinder to pivot to a lesser degree and thereby creates an angle between said pivot arm and said force resisting cylinder, and said angle increases as a function of said pivoting of said pivot arm, and resistance to pivoting increases as a function of said angle.

35. An exercise apparatus according to claim 34, wherein said back support includes a plurality of rollers rotatably mounted on said frame and extending substantially parallel to the floor surface and one another.

36. An exercise apparatus according to claim 34, wherein said head support includes a padded member, and rollers are disposed on opposite sides of said padded member and rotatably mounted relative thereto, and said rollers are configured and arranged to receive force transmitted through a person's shoulders.

37. An exercise apparatus according to claim 34, wherein said back support defines an angle of approximately thirty degrees relative to the floor surface.

38. An exercise apparatus according to claim 34, further comprising a foot supported mounted on said frame above the floor surface and above a surface defined by said back support.

* * * * *